United States Patent [19]

Brandl

[11] 4,109,866

[45] Aug. 29, 1978

[54] RECIPROCABLE SPRINKLER

[76] Inventor: Gerhard Brandl, Leonhardstrasse 79, A-8010 Graz, Austria

[21] Appl. No.: 786,395

[22] Filed: Apr. 11, 1977

[30] Foreign Application Priority Data

Apr. 9, 1976 [AT] Austria ..... 2607/76

[51] Int. Cl.[2] ..... B05B 3/08

[52] U.S. Cl. ..... 239/233

[58] Field of Search ..... 239/230–233, 239/505–511

[56] References Cited

U.S. PATENT DOCUMENTS

| | | | |
|---|---|---|---|
| 1,710,107 | 4/1929 | Orr | 239/233 |
| 3,559,887 | 2/1971 | Meyer | 239/233 |
| 3,580,507 | 5/1971 | Beamer | 239/233 |
| 3,623,666 | 11/1971 | Meyer | 239/233 X |

FOREIGN PATENT DOCUMENTS

| | | | |
|---|---|---|---|
| 706,405 | 3/1966 | Italy | 239/230 |

*Primary Examiner*—Johnny D. Cherry
*Attorney, Agent, or Firm*—Karl F. Ross

[57] ABSTRACT

A sprinkler designed to irrigate a certain sector of the ground comprises an upwardly sloping barrel, limitedly rotatable about a vertical axis, which terminates in a nozzle and carries two vertically oscillatable arms that are alternately effective to drive the barrel on a forward swing and on a return swing under the impact of the emitted water spray. The reverse-driving arm has a deflecting head which, on the return swing, lies in line with the nozzle and has two lands adjoining each other at an obtuse angle, i.e. a ramp face sloping upwardly in a radially outward direction and a reaction face of larger area including an acute horizontal angle with the radial direction. When the head is lowered into the path of the spray by an end stop, the impact of the water upon the ramp face pulls the reaction face into line with the nozzle against the force of a restoring spring. Another such spring, including a lost-motion connection, goes into effect in a position in which the spray impinges squarely upon the reaction face, thus tending to hold that face aligned with the nozzle but allowing the head to yield under excessive water pressure.

9 Claims, 3 Drawing Figures

RECIPROCABLE SPRINKLER

FIELD OF THE INVENTION

My present invention relates to a sprinkler for irrigating a field or a lawn in which a barrel or jet tube, terminating in a spray nozzle, is journaled on a strandpipe for limited rotation about a substantially vertical axis so that its spray sweeps a predetermined, preferably adjustable sector of the terrain.

BACKGROUND OF THE INVENTION

Sprinklers are known which can be swung back and forth over such a sector by the reaction force of the water spray impinging on respective faces of a pair of arms that are vertically oscillatable on the barrel, each of these faces forming part of a deflecting head which in a withdrawn position lies above the spray path and in a working position is operatively algined with the nozzle. When the rotating barrel reaches the terminal position of its forward swing, a stop on its mounting deactivates the forward-driving arm by upwardly retracting its deflecting head while operatively positioning the reverse-driving arm; when the barrel returns to the initial or home position of its swing, the positions of its arms are again reversed.

Generally, the deflecting head of the forward-driving arm is biased upwardly by a counterweight and has a reaction face so shaped that the impinging jet, aside from swinging the barrel in the forward direction, tends to move that head downwardly and out of the path of the spray. When this happens, the reaction force is briefly until the counterweight again raises the head into its working position which is defined by an abutment on that arm whereupon the operation is repeated. In this way, the barrel is advanced intermittently to the end of its forward sweep. Reference may be made in this connection to U.S. Pat. No. 3,580,507 showing such a drive mechanism.

In a reciprocating sprinkler as here contemplated, the return swing proceeds continuously rather than intermittently as the reverse-driving arm maintains its working position throughout that swing. Conventionally, the lowering of the deflecting head of this arm into alignment with the nozzle against the force of a restoring spring is arrested by a fixed abutment so that its reaction face cannot escape downwardly from the impact of the jet, contrary to the aforedescribed mode of operation of the forward-driving arm. A drawback of this arrangement resides in the fact that variations in the water pressure may lead to operating irregularities. Thus, if the restoring spring is weak enough to allow even a minimum pressure to return the barrel to its home position, larger pressures may excessively accelerate the barrel as the spray strikes the confronting reaction face with its full force; such an acceleration may damage the swivel mounting of the barrel or dislocate the stops which reverse the positions of the driving arms at the end of the return swing.

OBJECT OF THE INVENTION

The object of my present invention, therefore, is to provide means for eliminating this drawback in a sprinkler of the type referred to.

SUMMARY OF THE INVENTION

In accordance with my present invention, the deflecting head of the reverse-driving arm has several angularly adjoining lands, more specifically a ramp face sloping upwardly in a radially outward direction (as seen from the axis of rotation) and a reaction face including an acute horizontal angle with the radial direction, that is to say with a substantially vertical radial plane perpendicular to the ramp face. This ramp face serves to lower the reaction face into line with the nozzle upon being struck by the water spray; the reaction face is yieldably held in that aligned position, against the deflecting force of the spray, by biasing means having a nonlinear characteristic so as to provide a restoring force which intensifies as the reaction face reaches its confronting position.

BRIEF DESCRIPTION OF THE DRAWING

The above and other features of my invention will now be described in detail with reference to the accompanying drawing in which.

SPECIFIC DESCRIPTION

Figure 1:
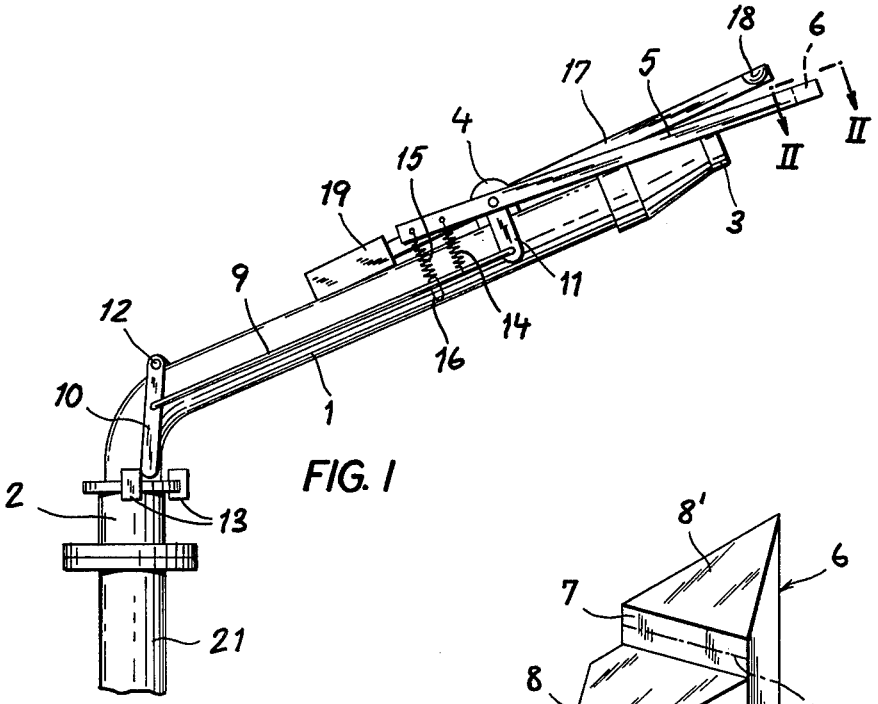
FIG. 1 is a side-elevational view of a sprinkler embodying my invention.
Figure 3:
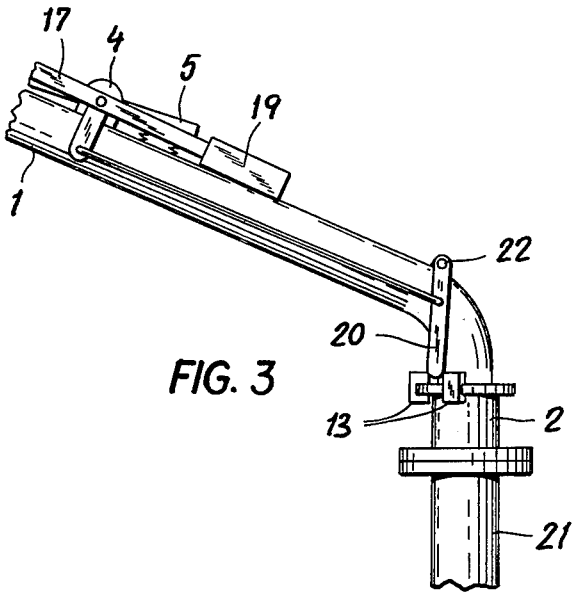
FIG. 3 is a partial elevational view similar to FIG. 1 but seen from the opposite side.

In FIG. 1 I have shown a lawn sprinkler comprising an upwardly sloping barrel or jet tube 1 which is journaled in a bearing 2 on a standpipe 21 for limited rotation about a vertical axis. The barrel 1 terminates in a spray nozzle 3 and has a lug 4 on which two arms 5 and 17 are mounted for oscillation about a common horizontal axis. Arm 17 has a deflecting head 18 which may be generally spoon-shaped, e.g. as described in U.S. Pat. No. 3,580,507, and is biased upwardly by a counterweight 19 seen in FIG. 3. When the barrel 1 is in an initial or home position, a lever 20 seen in FIG. 3 is pivoted about a fulcrum 22 on barrel 1 by one of several stops 13 on bearing 2 to coact with the weighted end of arm 17 so as to lower its head 18 into the path of the water spray emitted by nozzle 3; that arm then operates in the conventional manner described above to advance the barrel in a succession of steps into an alternate or terminal position where another stop 13 restores the illustrated position of lever 20 and arm 17. Simultaneously, another lever 10 fulcrumed on barrel 1 at 12 is pivoted by a further such stop 13 to oscillate the arm 5 about its axis through the intermediary of a rod-shaped link 9 which slidably extends alongside the barrel 1 and engages a lug 11 rigid with that arm; a deflecting head 6 of arm 5 is thereby lowered into the path of the emitted water spray.

Figure 2:
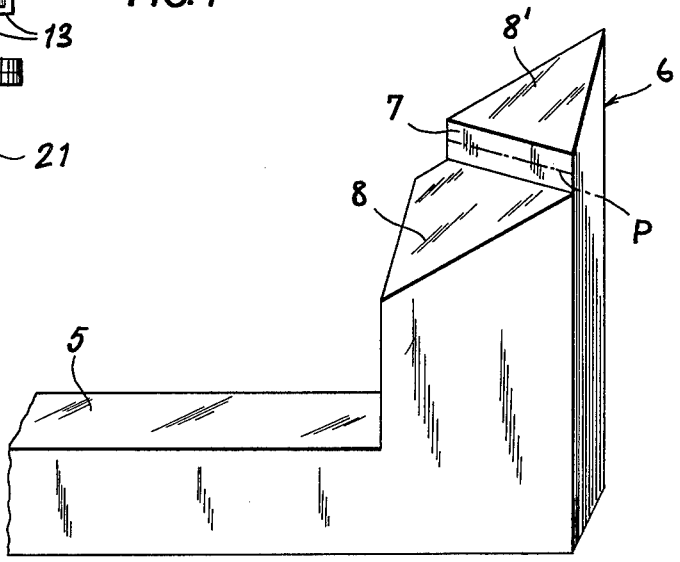
FIG. 2 is a fragmentary detail view drawn to a larger scale, taken on the line II — II of FIG. 1.

As illustrated in FIG. 2, head 6 has several lands 7, 8 and 8' adjoining one another at an obtuse angle, land 7 being a relatively narrow ramp face which slopes upwardly in a radially outward direction and is bisected by a substantially vertical plane P (indicated by a dot-dash line marking its intersection with that ramp face); plane P also includes the axis of nozzle 3. Land 8, of larger area than land 7, constitutes a reaction face which is inclined at an acute angle to the plane P and is drawn downwardly into confrontation with nozzle 3 by the spray striking the ramp face 7 when the arm 5 is first oscillated in a clockwise direction (as viewed in FIG. 1) by the lever 10 and its coacting stop 13. This lowering of face 8 into a confrontation position is resisted by a restoring spring 14, positively anchored to arm 5 and rod 9, with a relatively weak force allowing even a low-pressure jet to align this reaction face with the nozzle outlet. In the fully aligned position, however, a second restoring spring 15 comes into play, this latter spring being also positively anchored to arm 5 but engaging the barrel 1 through a lost-motion connection comprising a loop 16 loosely embracing the rod 9. By thus supplementing the restoring force of spring 14, spring 15 strongly resists a further lowering of deflecting head 6 by the water spray but allows such lowering in the presence of excess water pressure, thus letting the face 8 escape at least in part from the spray and slowing the backward swing of barrel 1. With the end of this backward swing, i.e. upon a return of the sprinkler to its home position, stops 13 again reverse the two arms 5 and 17 so as to deactivate the reverse-driving arm 5 and to reactivate the forward-driving arm 17 for a resumption of the cycle.

The stops 13 are preferably adjustable on bearing 2 to facilitate a change in the extent of the sectoral swing of the sprinkler. Also, it may be desirable to bias the barrel by a nonillustrated spring force or by a slight tilting of its axis of rotation toward one of its two limiting positions in order to insure that, in the event of an interruption of the water supply, the swing can be restarted in either a forward or a reverse direction by the activation of the corresponding driving arm.

Land 8', shown to be parallel to land 8, increases the reaction force exerted upon barrel 1 by the spray impinging on head 6.

Springs 14 and/or 15 could also be anchored directly to barrel 1 (with preservation of the lost-motion connection in the case of spring 15) rather than through the intermediary of rod 9.

I claim:

1. A sprinkler comprising:

a standpipe rising from the ground;

a barrel journaled on said standpipe for limited rotation about a substantially vertical axis, said barrel terminating in a spray nozzle remote from its axis of rotation;

a forward-driving arm and a reverse-driving arm vertically oscillatable on said barrel, said arms having outer extremities terminating in deflecting heads remote from said axis of rotation with surfaces intercepting a water spray from said nozzle for displacing said barrel in a respective direction of rotation upon a lowering of the respective deflecting head from a retracted position above the water spray into operative alignment with said nozzle;

stop means on said standpipe coacting with said arms for retracting the deflecting head of said reverse-driving arm in an initial rotary position while operatively aligning the deflecting head of said forward-driving arm and for upwardly retracting the deflecting head of said forward-driving arm in a terminal rotary position while operatively aligning the deflecting head of said reverse-driving arm, the deflecting head of said reverse-driving arm having a plurality of lands differently inclined to the nozzle axis, said lands including a reaction face and a ramp face adapted to lower said reaction face into a position of confrontation with said nozzle upon being struck by the water spray; and biasing means with a nonlinear characteristic on said barrel engaging said reverse-driving arm for yieldably arresting said reaction face in line with said nozzle, against a deflecting force of said water spray, by a restoring force intensifying in said position of confrontation.

2. A sprinkler as defined in claim 1 wherein said ramp face has a smaller area than said reaction face.

3. A sprinkler as defined in claim 1 wherein said biasing means comprises a first restoring spring urging the deflecting head of said reverse-driving arm into said retracted position and a second restoring spring effective in a position of substantially full confrontation of said nozzle with said reaction face for resisting further lowering of said reaction face by the impinging water spray.

4. A sprinkler as defined in claim 3 wherein said second restoring spring is anchored to said barrel by a lost-motion connection.

5. A sprinkler as defined in claim 4 wherein said reverse-driving arm is provided with a link slidable alongside said barrel for coaction with said stop means, said lost-motion connection comprising a looped end of said second restoring spring embracing said link.

6. A sprinkler as defined in claim 5 wherein said first restoring spring is positively connected with said link.

7. A sprinkler as defined in claim 1 wherein said ramp face slopes upwardly in a radially outward direction with reference to said axis of rotation.

8. A sprinkler as defined in claim 7 wherein said reaction face adjoins said ramp face at an obtuse angle and includes an acute angle with a substantially vertical radial plane perpendicular to said ramp face.

9. A sprinkler as defined in claim 8 wherein said lands further include a face substantially parallel to said reaction face beyond said ramp face.

* * * * *